US005954074A

United States Patent [19]

Mattson

[11] Patent Number: 5,954,074

[45] Date of Patent: Sep. 21, 1999

[54] UNIVERSAL ADJUSTABLE WALKING CRUTCH AND/OR CANE

[76] Inventor: Evert C. Mattson, 13932 E. 3rd Ave. P.O. Box 81, Brule River, Wis. 54820

[21] Appl. No.: 08/937,209

[22] Filed: Sep. 17, 1997

Related U.S. Application Data

[60] Provisional application No. 60/026,494, Sep. 19, 1996.

[51] Int. Cl.[6] ..... A61H 3/02

[52] U.S. Cl. ..... 135/68; 135/69; 135/72; 135/73

[58] Field of Search ..... 135/67, 68, 69, 135/72, 73, 74, 75

[56] References Cited

U.S. PATENT DOCUMENTS

| | | | |
|---|---|---|---|
| 869,128 | 10/1907 | Autenrieth . | |
| 1,652,110 | 12/1927 | Fullington | 135/69 |
| 2,172,178 | 9/1939 | Rosenberg | 135/69 X |
| 2,429,409 | 10/1947 | Eidman | 135/72 |
| 2,590,607 | 3/1952 | Grimball . | |
| 2,630,128 | 3/1953 | Slater . | |
| 2,960,095 | 11/1960 | Smith . | |
| 3,208,461 | 9/1965 | Irwin . | |
| 3,272,210 | 9/1966 | Boruvka | 135/69 |
| 3,387,618 | 6/1968 | Swann | 135/67 |
| 3,553,746 | 1/1971 | Seiger | 135/67 X |
| 4,733,682 | 3/1988 | Ellena | 135/69 |
| 4,917,126 | 4/1990 | Ellmore | 135/69 |
| 4,979,533 | 12/1990 | Hansen et al. | 135/72 |
| 5,139,040 | 8/1992 | Kelly | 135/69 |
| 5,201,334 | 4/1993 | Tseng | 135/68 |
| 5,282,486 | 2/1994 | Hoover | 135/75 X |
| 5,482,070 | 1/1996 | Kelly | 135/66 |
| 5,725,005 | 3/1998 | Yamasaki et al. | 135/73 |

OTHER PUBLICATIONS

"Aerofit" Crutch as Shown by the Second Power Co., Belvidere, IL.

"Klick" Crutch as Shown by the Thomas Fetterman, Inc. Co. Southampton, PA.

*Primary Examiner*—Carl D. Friedman

*Assistant Examiner*—Winnie S. Yip

[57] ABSTRACT

This disclosure relates to combination adjustable crutches and/or canes that can be converted from a crutch to a cane or vice versa. The present invention includes a main single support shaft made of lightweight-ridged square tubing. A unique handle that clamps onto said square support shaft. Additionally, a novel underarm support cradle with stem that telescopes inside said square support shaft to be adjusted up or down. Also, a novel way and means to provide auxiliary forearm support. Patient's hand wrist, forearm and upper arm then being in a natural ergonomic position, without twisting or bending of patient's hand, wrist and upper arm. Fatigue, discomfort, and pain then being minimized or eliminated. Also, a crutch/cane that can be firmly set aside, out of the way, in an upright position on a horizontal surface when not in use.

16 Claims, 8 Drawing Sheets

UNIVERSAL ADJUSTABLE WALKING CRUTCH AND/OR CANE

BACKGROUND—CROSS REFERENCE

Figure 1A:
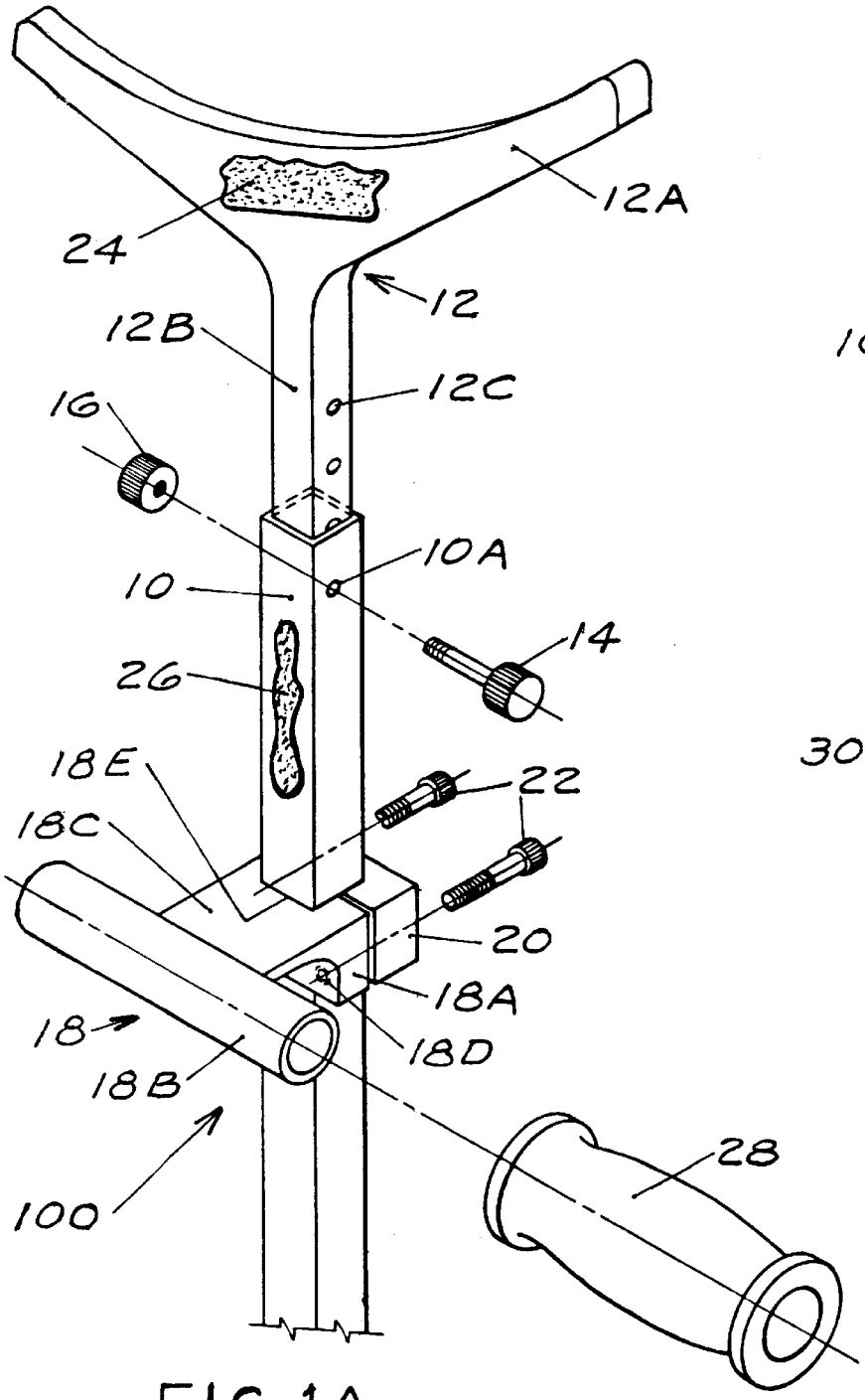
Figure 1B:
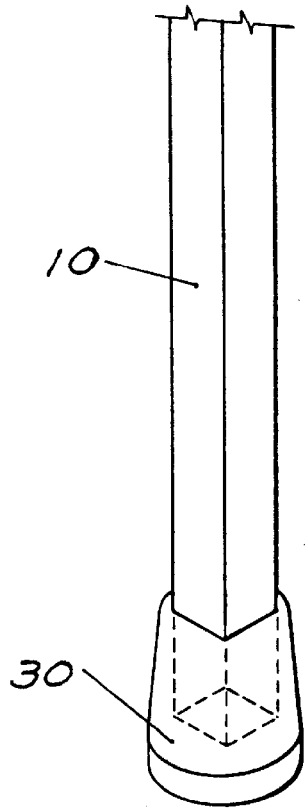

This application claims the benefit of U.S. Provisional patent application Ser. No. 60/026494 filed Sep. 19, 1996.

BACKGROUND—FIELD OF INVENTION

This invention relates to general purpose, adjustable, walking crutches and/or canes. More specifically to such apparatus that has a main single support shaft that can be converted from a crutch to a cane, or vice versa. Applicant is aware that this field is highly developed and classified as crowded art; therefore, each small step forward should be considered significant, especially when it brings added comfort to the disabled.

BACKGROUND—PRIOR ART

All known crutches and canes have characteristics and features that are considered advantages, and some that are undesirable. A given feature of one type may be an advantage to one person and a disadvantage to another. The author of this document has used various crutches and canes since 1943, and has been a successful mechanical designer for the past fifty years. From experience, the following is set forth.

Those with lower extremity fractures or other disabilities are commonly instructed to bear only a certain part of there weight on the disabled lower limb when using a crutch or cane. Too much weight can cause further injury or discomfort and too little weight can slow the healing process. When the patient begins to walk with a new crutch or cane and cannot sense balanced weight distribution nothing seems to work satisfactorily. A clinical therapist may assist or advise the patient and monitor his/her performance; however, this method provides only limited qualitative analysis. In the end it is a matter of the patient's mental attitude and the configuration of the crutch or cane being used. A properly designed crutch or cane that provides sensible, biotechnical ergonomics will go a long way to insure controlled weight distribution and support, therefore greater comfort and safety. In the field of crutches and canes; the prior art we see today fails to show well thought out, ergonomically engineered crutches and/or canes. They are overly complicated, over-designed, and over-weight. The less a crutch weighs the better it will serve its master. And, the less complicated it is the better it will be received by those who are concerned with medical cost containment. The present invention strives for simplicity, ultra lightweight, comfort, safety, and low cost.

We are all familiar with the conventional axillary bow-type tubular crutch which consists of a pair of bowed tubes, side-by-side, bridged at their upper extremities by an under arm support and at the midsection by a handle grip. And, with a tubular carrier between the lower bow parts with an adjustable foot member engaged in the carrier tube. This popular, time worn, crutch is shown in U.S. Pat. No. 4,733,682 to Ellens, Dec. 16, 1986. Although this type of crutch has been reinvented many times, and millions have been sold, basically it is poorly designed, because:

(a) The users wrist and hand is forced to curl inward to grasp and hold the crutch. This offset hand position does not promote comfortable, balanced, weight distribution.

(b) Over the years the dynamic loads exerted on the user's hand, wrist and upper arm (in the aforementioned offset condition), have been known to cause hand, wrist and arm ailments that can be troublesome.

(c) This crutch is not considered light-weight; therefore, it does not provide quick response, especially with the user's hand twisted in an awkward position. Also, because of its weight, this type of crutch is tiresome to carry around.

(d) Not only is this crutch clumsy, it is ugly and depressing, resulting in an adverse psychological effect on the user.

(e) In addition, this crutch is forever falling over when leaned against a wall or table, causing the user undue embarrassment and trouble.

Another crutch that is very popular is the so-called Canadian Forearm Crutch distributed by Thomas Fetterman, Inc., Canada. This type of crutch has some attributes to be admired; however, it comes with a support collar that wraps around the user's forearm. The problem being, if the user stumbles and falls, the crutch gets in the way because it is fixed to the user's forearm. The end result being that the user gets tangled up with the crutch when falling, which could result in further injury. This crutch is now recognized as being dangerous and is no longer recommended by medical professionals.

U.S. Pat. No. 5,482,070 to Kelly, Jan. 9, 1996, is nearer to the present invention. The drawbacks to the Kelly crutch/cane are as follows:

(a) The Kelly crutch itself has 41 separate components, not including set screws, mentioned, but not shown. The multiplicity of parts, including the three round tubular telescoping members 10, 11, and 12, make the Kelly crutch/cane overly complicated, heavy, and unwieldy. Also, the design of this crutch/cane signifies high manufacturing costs.

(b) Kelly touts a novel unitary connector and hand grip support 30, which is joined to middle tubular member 11 by means of a tight friction fit. He then goes on to mention that a set screw may be needed to fix hand grip support 30 in place on tubular member 11 if all else fails. This leads the reader to believe that Kelly is unsure of himself. If there is to be a tight friction fit between hand-grip support 30 and tubular member 11, then there must be a controlled interference fit between the two. An interference fit, in this case, is very unlikely since both members are made of dissimilar materials and processes that do not lend themselves to precision dimensional tolerances needed for a press fit. Press fitting hand-grip support 30 over tubular member 11 to obtain a tight friction fit is very unlikely in high production, as a matter of fact it is unrealistic. It will be either too loose or too tight.

(c) If hand-grip support 30 is molded to slip-fit over tubular member 11 and a set screw is used to secure said hand-grip in place then you have a mechanical assembly that is untrustworthy. In this case, set screws are not reliable; they will work loose.

(d) In the disclosure Kelly mentions that the uppermost end of lower tubular member 12 is provided with a collar 40 to ensure a snug fit of tubular members 11 and 12. He does not, however, show the configuration of collar 40; therefore, Kelly's disclosure is flawed.

(e) In the disclosure Kelly shows hand-grip 32 directly below and perpendicular to underarm support 13 straight out in front of the user. This means the user must curl his hand and wrist inward to grasp and hold crutch. The patient's hand and wrist then being in an awkward position much the same as seen in the axillary bow-type crutch. Again, no consideration is given to even weight distribution and overall comfort.

(f) The multitude of parts in the Kelly crutch can only lead one to believe that this crutch is not light weight as claimed; therefore, it is not likely to afford quick response, especially with the handle positioned as it is.

(g) The Kelly crutch has 41 individual parts. The present invention by Applicant has 12 parts; therefore, weighs much less and is far less expensive.

OBJECTS AND ADVANTAGES

Besides the objects and advantages of the adjustable crutch/cane described herein, several other objects and advantages are as follows:

(a) To provide a device that can be simply and easily converted from a crutch to a cane or vice versa without losing its structural integrity or aesthetics.

(b) To provide a crutch/cane that has one single weight-bearing column made of thin wall square aluminum or plastic tubing without a multitude of adjustment holes or apertures, as seen in prior art; thereby, producing a superior light weight, high strength column; wherein strength to weight ratio is paramount.

(c) To provide an ultra light crutch/cane that produces quick response time, resulting in easy maneuverability that is less tiring; thereby providing the patient with better overall control and assurance of well being.

(d) To provide a crutch/cane that provides additional forearm support means without the need for a special forearm collar or forearm saddle.

(e) To provide a crutch/cane that takes into consideration common hand and wrist ailments that plague many crutch/cane users such as carpal tunnel syndrome, arthritis and tendinitis.

(f) To provide a crutch/cane that reduces stress concentration on the patient's hand, wrist, and upper arm by placing the handle in an optimum ergonomic position directly below the theoretical center of the human shoulder.

(g) To provide a crutch/cane whereby the forces bearing on the patient's hand, wrist, and upper arm are evenly distributed, thereby helping the user to control and distribute his/her overall weight on the user's disabled limb as needed.

(h) To provide a crutch/cane whereby user's wrist, forearm, and upper arm are arranged in order to be substantially straight and rigid in operation of said crutch/cane. Whereby, user's arm is not required to bend at the elbow as seen in prior art.

(i) To provide a crutch/cane with a handle that is unrestricted at both ends, whereby the user's hands are free to grab the handle from any direction without interference from other crutch parts as seen in prior art.

(j) To provide a crutch/cane with a handle that is infinitely adjustable, up or down, thereby eliminating incremental multiple adjustment hole apparatus apertures for handle height adjustment as seen in prior art.

(k) To provide a crutch/cane that takes into consideration old fragile people who are still mobile but weak and unstable, often falling down and injuring themselves because they are ill served by the traditional crutches and canes now in use.

(l) To provide a crutch/cane that can be conveniently set aside; in an upright position; simply, by setting the crutch handle on a solid horizontal surface such as a table top, counter top, window sill, etc.

(m) To provide a crutch/cane that is pleasing to the eye because of its elegant simplicity.

(n) To provide a crutch/cane that gives the user a psychological lift.

(o) To provide a crutch/cane whereby the handle grip can be conveniently and easily removed and replaced for washing and rinsing; thereby, eliminating harmful bacteria residing on the surface of said handle grip.

Further objects and advantages are to provide a combination crutch/cane that is simple, inexpensive to manufacture, and pleasing to the eye.

A crutch/cane that is ultra light-weight, sturdy, and highly maneuverable, providing a walking aid that provides greater security and safety.

A crutch/cane that places the hand grip in a ergonomically correct position, thereby preventing, reducing, and even eliminating common hand wrist and upper arm ailments.

A crutch/cane that provides the patient with auxiliary forearm support in the form of a simple plastic or rubber foam sleeve covering said square support shaft.

A crutch/cane that provides greater comfort for the disabled who use crutches or canes on a daily basis for long periods of time.

Also, a crutch/cane that can be firmly set aside, (at rest), in an upright position on a solid horizontal surface such as a table top, counter top, or window sill without tipping, rolling around, or falling down.

Also, a universal crutch/cane that will rid the world of the old traditional axillary bow type crutch that is now obsolete.

Still further, objects and advantages will become more apparent after consideration of the ensuing description and drawings.

DRAWING FIGURES

The drawings of the present invention are shown on eight separate sheets marked 1 through 8. In the drawings, closely related figures have the same number, but different alphabetic suffixes. Front and side view call-outs will be in accordance with the profile of a human being.

FIGS. 1A/1B, (sh. 1), shows an exploded isometric view of the invention in its full crutch mode.

Figures 2A, 2B:
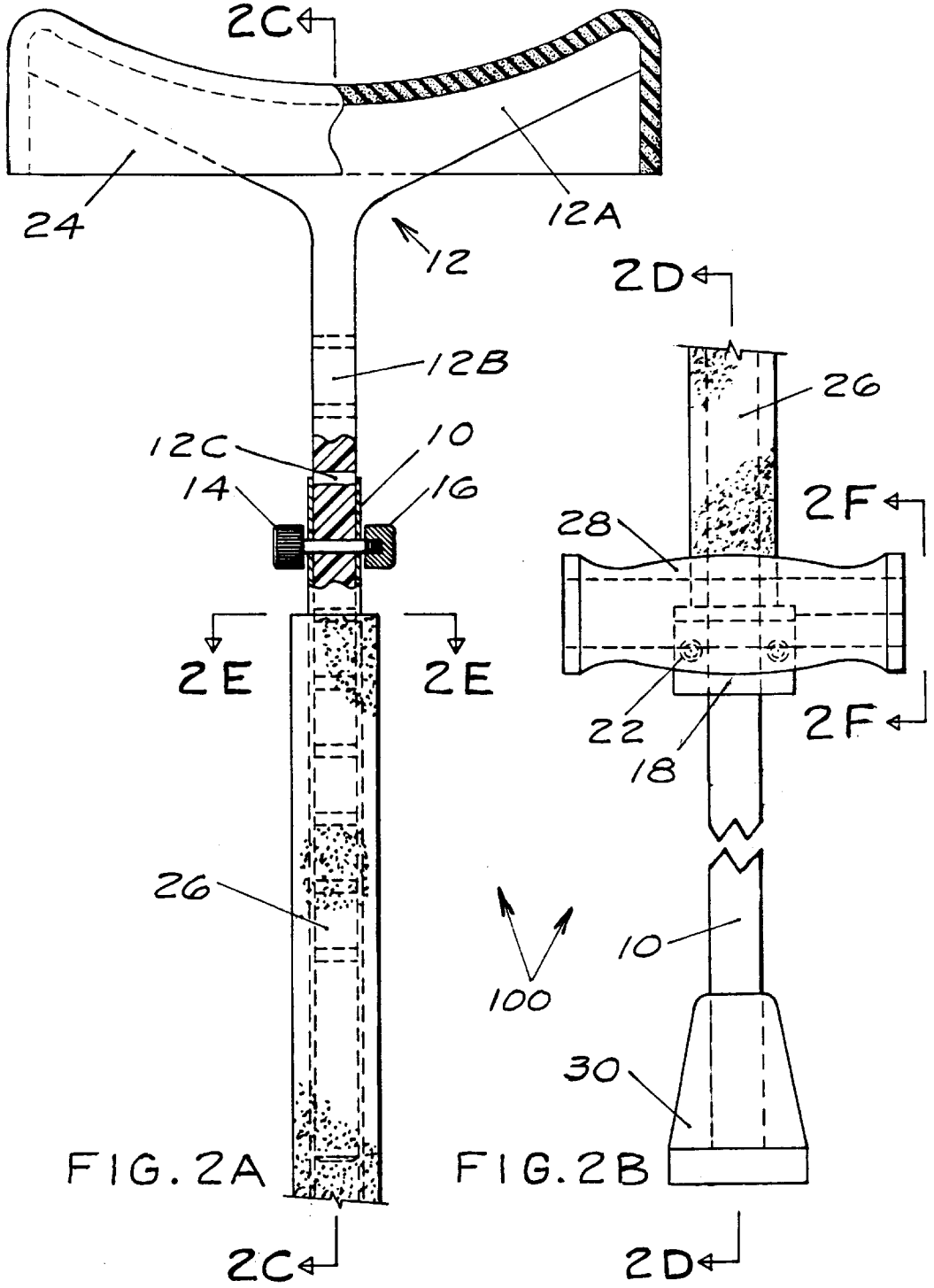

FIGS. 2A/2B, (sh.2), shows an orthogonal side view of the invention.

Figure 2C:
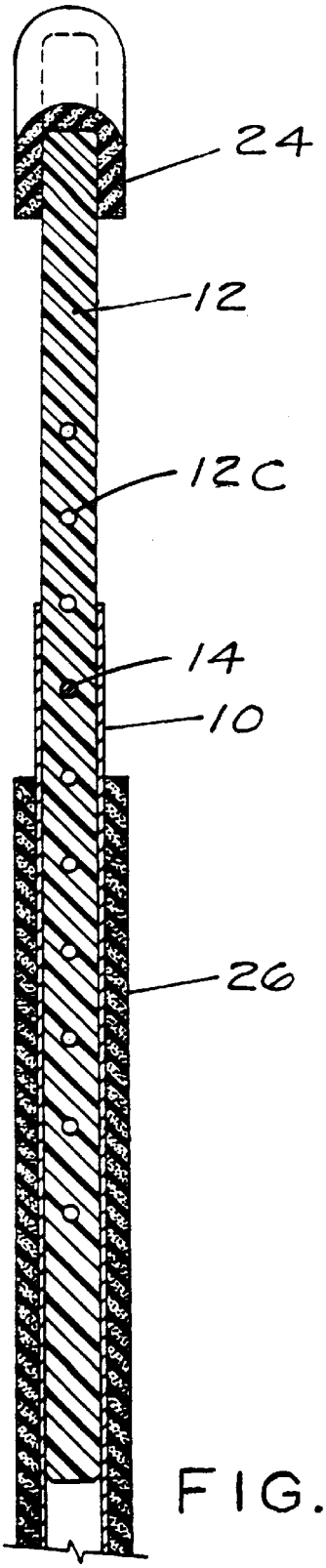

FIGS. 2C/2D, (sh. 3), shows a full cross section of the invention taken from FIGS. 2A/2B.

Figure 2D:
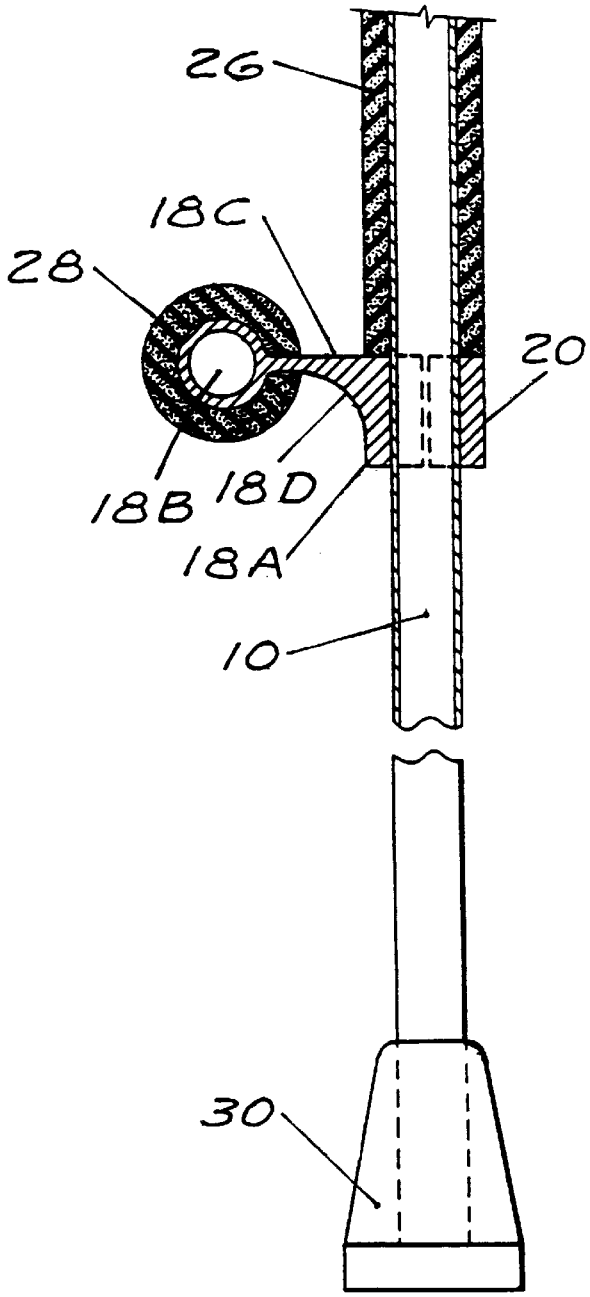
Figure 2E:
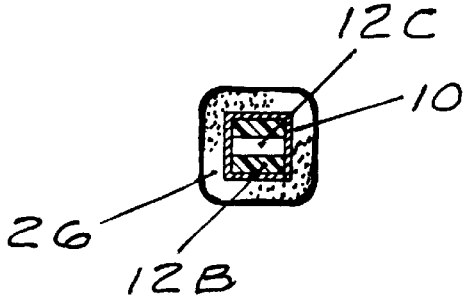

FIGS. 2E, F & G, (sh. 4), shows various detail aspects of the invention for a closer view.

Figure 3:
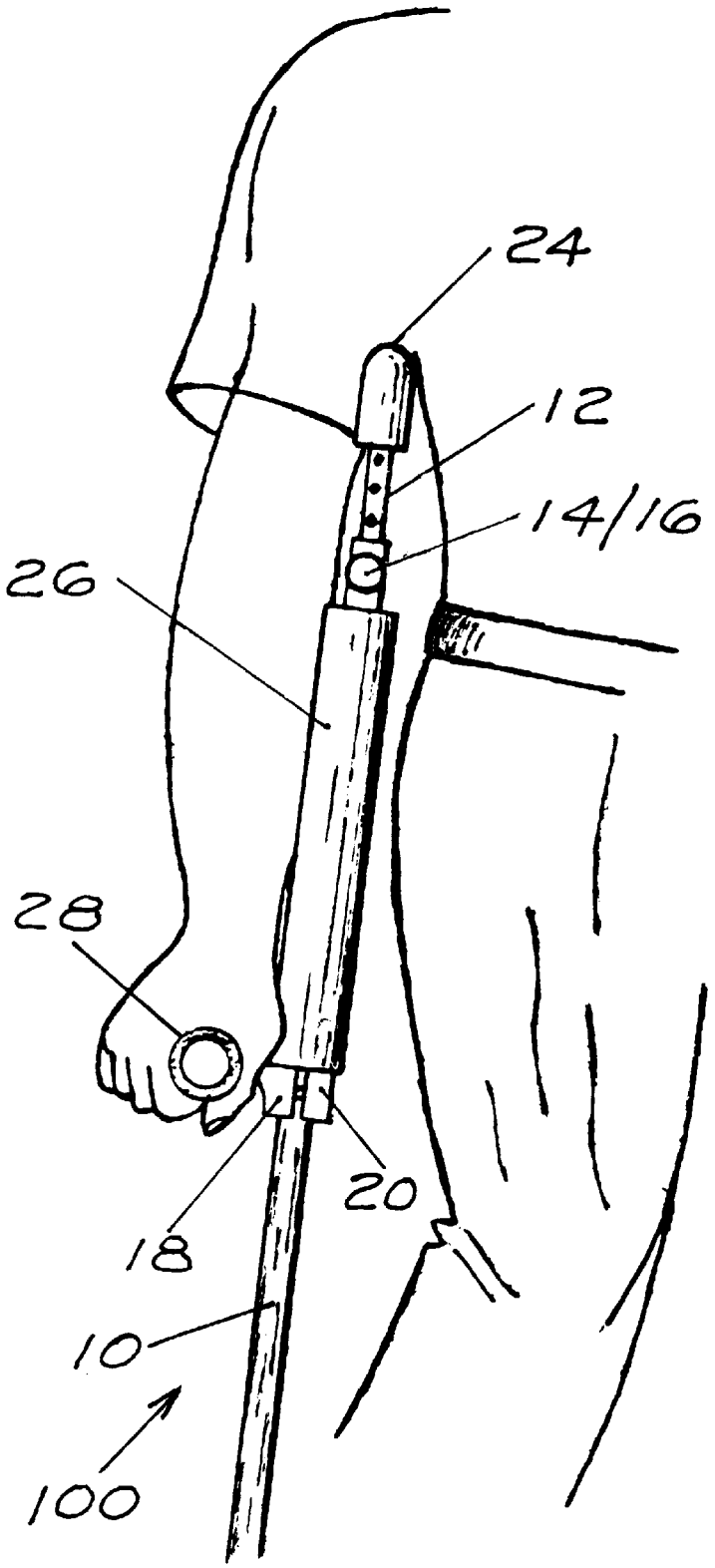

FIG. 3, (sh. 5) shows a pictorial view of a human form including shoulder, arm, wrist and hand, with crutch in operating position.

Figure 4:
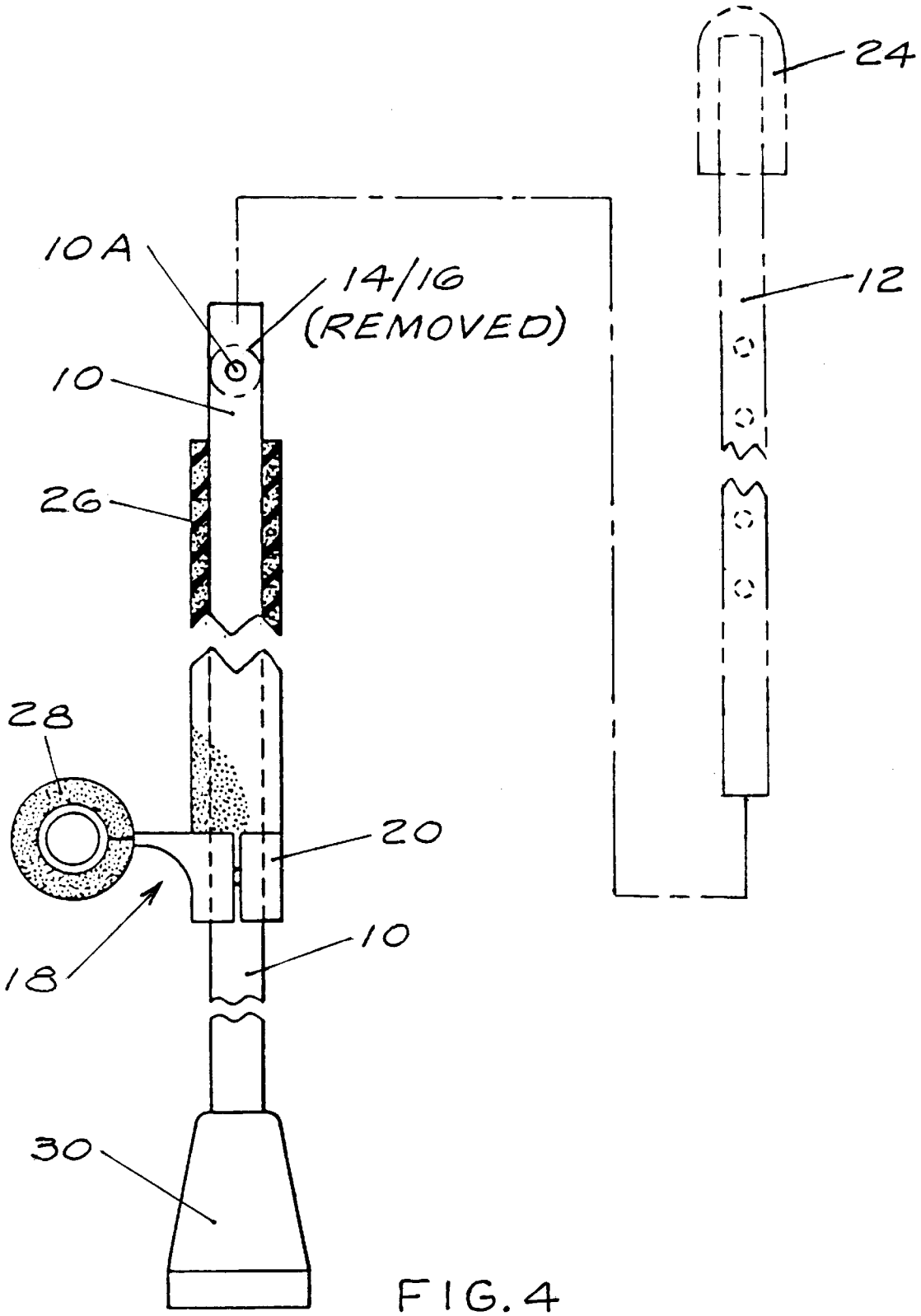

FIG. 4, (sh. 6), shows an orthogonal front view of the present invention in cane mode with underarm cradle removed.

Figure 5:
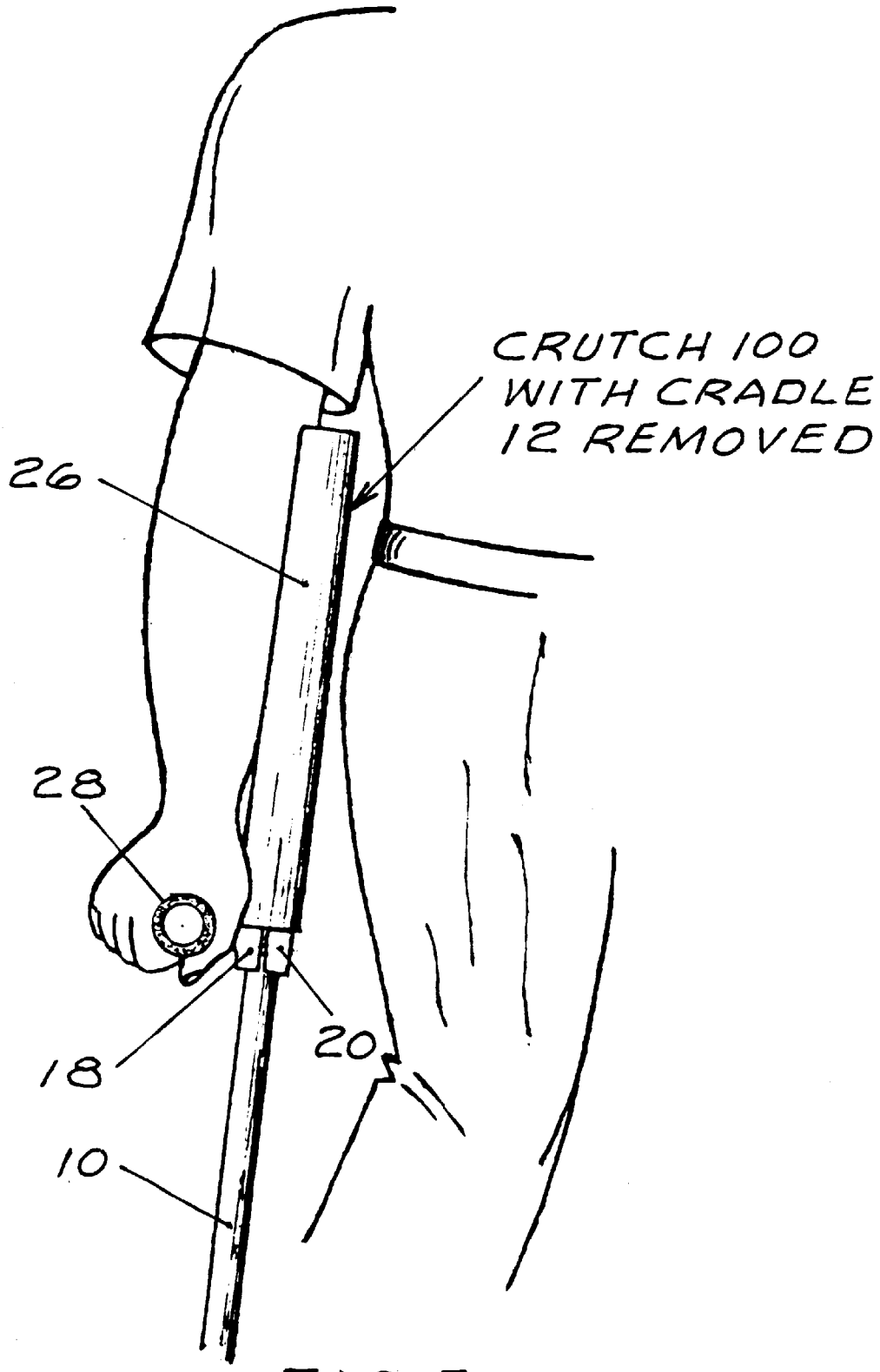

FIG. 5, (sh. 7), shows a pictorial view of a human form, shoulder, arm, wrist, and hand, with cane in operating position.

Figure 6:
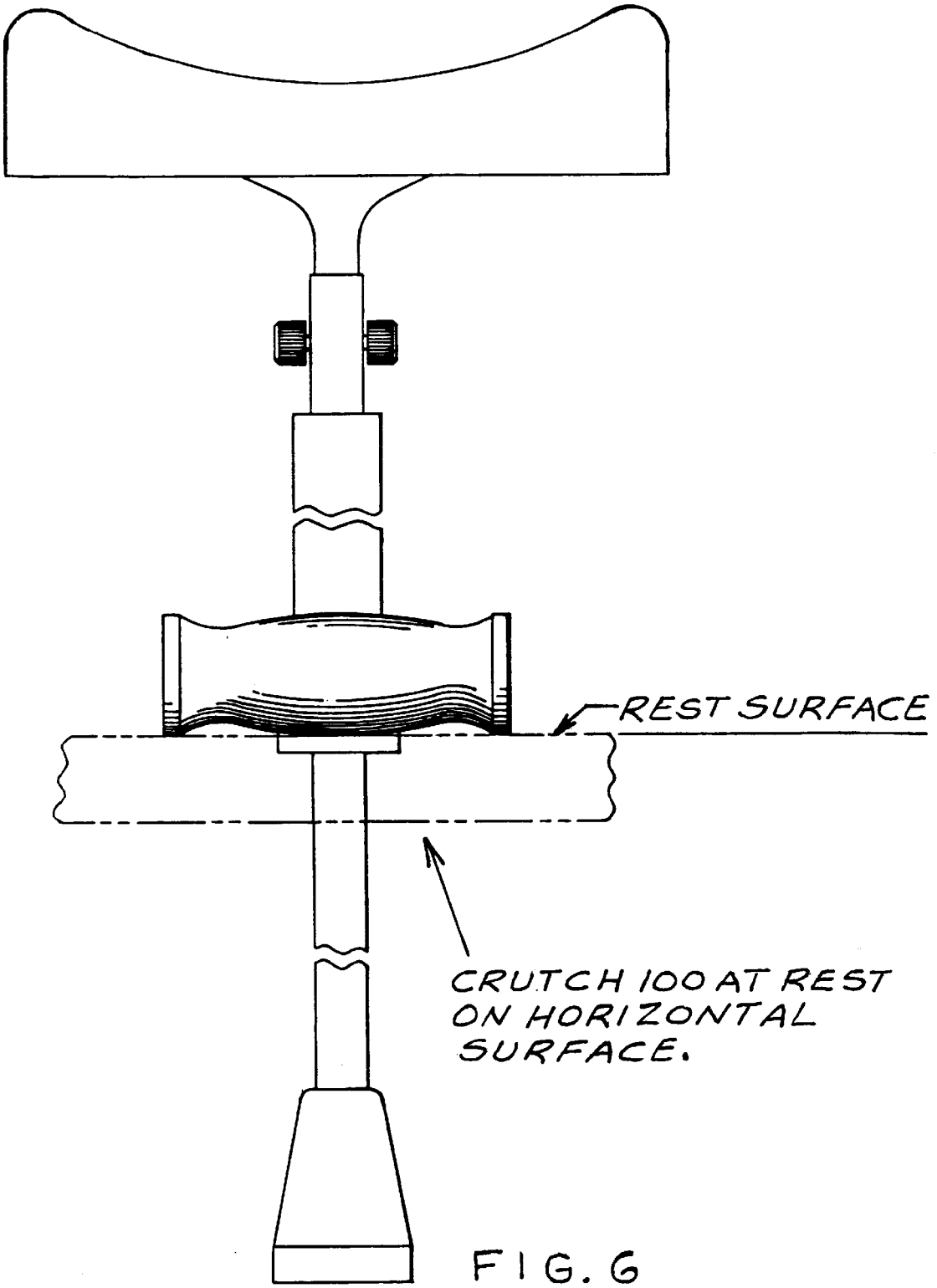

FIG. 6, (sh. 8), shows an orthogonal side view of crutch setting at rest in an upright position on a horizontal surface.

| Reference Numerals In Drawings | |
|---|---|
| 100 | crutch/cane assembly |
| 10 | support shaft |
| 12 | underarm cradle |
| 14 | cradle pin |
| 16 | thumb nut |
| 18 | crutch handle |
| 20 | handle clamp |
| 22 | clamp screw, (two) |
| 24 | cradle cap |
| 26 | forearm sleeve |
| 28 | handle grip |
| 30 | crutch tip |

SUMMARY

In accordance with the present invention, a convertible, adjustable crutch/cane comprising a single square tubular support shaft with resilient crutch tip on lower end thereof, a clamp-on handle with separate, removable, handle-grip, a telescoping underarm support cradle, and a forearm support sleeve fitted over support shaft; said crutch then being converted to a cane by removing underarm cradle.

DESCRIPTION—FIGS. 1 through 8

A typical embodiment of my invention is illustrated in FIGS. 1A/1B, wherein it is shown that the present invention consists of only twelve individual components 10 through 30.

As shown in FIGS. 1A/1B, main support shaft 10 is the central part of the invention. Preferably, support shaft 10 is fabricated from 18.9 mm, (¾ inch), square high strength aluminum or composite plastic tubing having 1.6 mm, (1/16 inch), side walls resulting in 15.7 mm, (⅝ inch), square inside dimension. The length of support shaft 10 being designed to suit the height of various persons; (short, medium, tall). Note that support shaft 10 has but one hole, 10A through said shaft at upper end of said shaft; used to receive cradle pin 14.

Again, referring to FIG. 1A, there is shown underarm cradle 12 including cradle bed 12A with extended cradle stem 12B having a series of height adjustment holes 12C through stem 12B. Preferably, cradle 12 will be a singular molded composite plastic part nominally 15.7 mm, (⅝ inch), thick throughout. Also shown in FIGS. 1A/1B are pictorial views of remaining items; cradle pin 14, handle clamp 16, crutch handle 18, handle clamp 20, clamp screw 22, cradle cap 24, forearm sleeve 26, handle grip 28, and crutch tip 30.

Now referring to FIG. 2A, which is an orthogonal side view of the invention. As shown, cradle 12 by means of extended cradle stem 12B telescopes inside shaft 10 and is fixed in place by means of cradle pin 14 which is held in place by thumb nut 16. Also shown in FIG. 2A is cradle cap 24, which is preferably a molded foam rubber or plastic cover made to stretch-fit over cradle bed 12A that serves as an underarm cushion.

Referring now to FIG. 2B, there is shown a side view of handle 18 with handle grip 28, in place, centered laterally on shaft 10, perpendicular to said support shaft; handle-grip 28 being on a horizontal plane parallel to the face of said underarm cradle 12. Also shown in FIG. 2B is a side view of crutch tip 30 which is a standard commercial round resilient crutch tip with a typical round socket hole that form-fits nicely over the square end of support shaft 10.

Referring now to FIG. 2C, there is shown a cross-sectioned front view of the invention taken from FIG. 2A. Again, it is shown that cradle stem 12B extending from cradle bed 12A slip-fits, (telescopes), inside shaft 10 making it possible to raise or lower said underarm cradle for crutch height adjustment purposes. Also shown is a cross-section of cradle pin 14 fitted in cradle stem 12B.

Cradle stem 12B will then be nominally 15.7 mm, (⅝ inch), square, sized to slip-fit inside support shaft 10. In cradle stem 12B there is shown a series of holes 12C used for crutch height adjustment. Adjustment holes 12C in cradle stem 12B are positioned to line up with through hole 10A in support shaft 10 thereby permitting cradle pin 14 to be inserted in and through shaft 10 and cradle stem 12B, fixing said cradle 12A in a given position by means of thumb nut 16.

In FIG. 2C there is also shown forearm sleeve 26, which is a length of round foam rubber or plastic tubing sized to slip-fit over support shaft 10.

Referring now to FIG. 2D there is shown a cross-sectioned front view taken from FIG. 2B, which emphasizes a view of handle 18 along with handle clamp 20 and handle grip 28. Preferably, handle 18 is an integral part made of cast aluminum or molded composite plastic incorporating handle body 18A, tubular handle bar 18B, integral flange 18C, support radius 18D and keyway slot 18E. As shown, handle bar 18B is supported by an integral flange 18C having a rectangular cross-section that extends out from handle body 18A, which is then supported and strengthened by radius 18D under said flange. Further, (as best shown in FIG. 1A), said handle body 18A incorporates a female keyway seat 18E sized to slip-fit over shaft 10 encasing said support shaft; thereby, mounting and keying handle 18 in place on shaft 10. In addition, as shown, handle body 18A incorporates two threaded holes to facilitate clamping handle 18 in place on support shaft 10.

Referring again to FIG. 1A, there is shown handle clamp 20, which is preferably made of aluminum or composite plastic. The purpose of clamp 20 being to clamp handle 18 in place on support shaft 10 using clamp screws 22. As shown in FIG. 1A, clamp 20 also incorporates a female keyway seat that slip-fits over shaft 10, in the same manner as handle 18; thereby, encasing shaft 10 on all sides.

Now referring to FIG. 2E, which is a cross-section taken from FIG. 2C that shows shaft 10 with underarm cradle 12 in place and forearm sleeve 26 form fitted on outside of said shaft. Although forearm sleeve 26 is made of round foam rubber-like tubing, when fitted over shaft 10 it takes on a semi-square shape, as shown in FIG. 2E. The wall thickness of sleeve 26 then being thick enough to make contact with the user's forearm as shown in FIGS. 3 and 5.

Figure 2F:
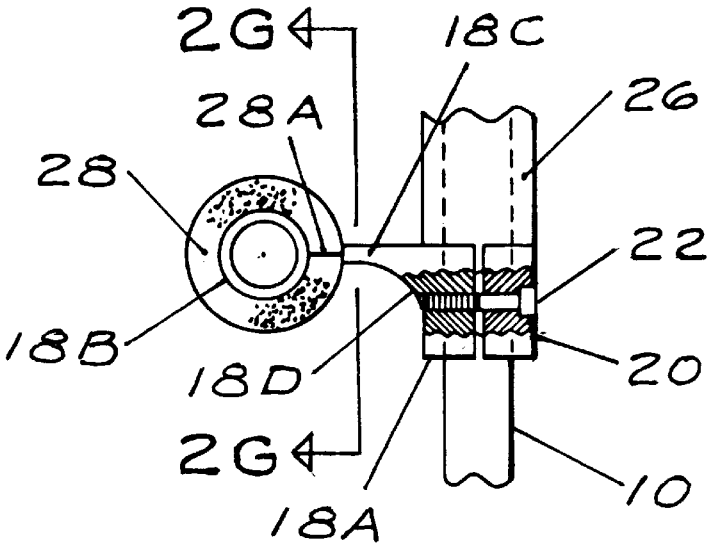

Now referring to FIG. 2F, there is shown a view taken from FIG. 2B, which shows handle 18 and clamp 20 assembled in place with clamp screw 22 of which there are two, side by side, thereby clamping handle 18 in place on support shaft 10 by means of clamp 20. As shown in the partial cross-section of FIG. 2F, handle 18 is threaded and clamp 20 is provided with matching clearance holes to accommodate clamp screws 22, enabling the user to clamp handle 18 in place on shaft 10 using clamp 20 and clamp screws 22.

Figure 2G:
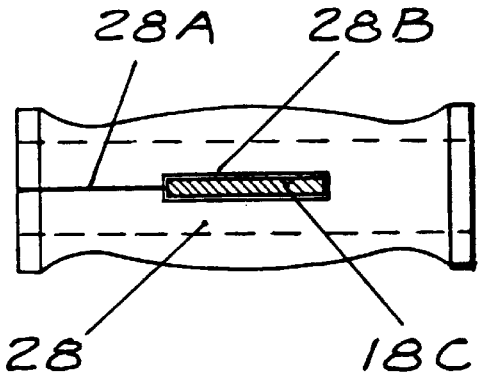

Referring now to FIG. 2G, there is shown a cross-section taken from FIG. 2F, wherein there is shown a section thru handle flange 18C. In FIG. 2G, there is also shown a side view of handle grip 28, wherein there is shown slit, 28A, and slot, 28B. A front view of slit 28A is also shown above in FIG. 2F. Slit 28A and slot 28B are incorporated into handle grip 28 to allow assembly of said handle grip 28 with handle 18. As shown, slit 28A and slot 28B are through only one side of grip 28. Fixing handle grip 28 on handle 18 is then a simple matter of sliding said handle grip over tubular handle bar 18B. Handle grip 28 is then keyed in place by means of handle-flange 18C as shown.

Referring now to FIG. 3, there is shown a pictorial view of a human figure using the said crutches as intended with the user's arm in a straight rigid position leaning against forearm sleeve 28 for additional support.

Referring now to FIG. 4, there is shown a front view of the invention in cane mode only. As shown, converting from crutch to cane is a simple matter of removing cradle pin 14, then removing cradle 12. While the cane, as shown, does not look like a traditional cane, it has some outstanding attributes that will be explained.

Now, referring to FIG. 5, there is shown a pictorial view of a human figure using the cane as intended with the user's arm in a straight rigid position leaning against forearm sleeve 28 for additional support.

Referring now to FIG. 6, there is shown a side view of said crutch/cane at rest on a horizontal surface. Note that the crutch or cane sets firmly on handle grip 28 placing the crutch/cane in a stable upright position. As shown, the handle grip sets parallel to the horizontal resting surface; thereby, preventing the crutch or cane from swinging or pivoting about the handle.

From the foregoing description, a number of advantages of said convertible crutch/cane become evident.

(a) It can be initially used as a crutch and subsequently used as a cane after the need for a crutch no longer exists.

(b) There is a definite division between crutch and cane. Whether it be a crutch or cane, it maintains its integrity and simple, elegant, aesthetics.

(c) Manufacturing cost is minimal because of simple of design and minimum number of parts.

(d) Because of its planned structural attributes, it is light weight, sturdy, highly maneuverable, comfortable, and safe to use.

(e) It is less likely to aggravate or cause hand, wrist, and upper arm ailments mainly because the user's arm is generally in a straight rigid position and the user's hand is turned outward placing the user's body weight across the bed of the palm of the user's hand.

(f) The forearm support sleeve will reduce the number of injuries caused by patients accidentally falling down; whereby the patient can lean on the foam forearm sleeve for support; thereby, eliminating the so-called "wobbly cane" syndrome.

(g) Be it crutch or cane, it can be conveniently set aside in a firm, stable, upright position on any readily available horizontal surface.

(h) It is inherently unobtrusive; simplicity being the essence of elegance; a delight to own and use.

OPERATION

To adjust the working height of the crutch it is a simple matter of removing cradle pin 14, as shown in FIG. 1A. Underarm cradle 12 can then be raised or lowered to suit the height of the individual user and then be re-pinned, as shown in FIG. 2A.

To raise or lower handle 18 it is a simple matter of loosening clamp screws 22, then sliding said handle up or down to desired position, then re-tightening said clamp screws. The crutches fit correctly when said crutch tips are aligned 15.2 cm, (6 inches), outside user's feet and aligned with user's arm in a straight position. And, with said cradle bed being 5.1 cm, (2 inches), below underarm, (armpit), of user.

Change over, from crutch to cane, is simply a matter of removing cradle pin 14 then underarm cradle 12. The device then serves as a cane with forearm sleeve remaining in place as shown in FIG. 5.

Be it a crutch or cane, forearm support is largely involuntary. In operation, the patient automatically leans against forearm sleeve 26 which is totally and firmly supported by shaft 10.

To set aside crutch or cane in a up-right rest position, it is a simple matter of placing handle 18 with hand-grip 28 in place on a horizontal surface as shown in FIG. 6, said horizontal surface can be a table top, a counter top, a window sill, or the like. Note: the crutch/cane stays where it is put without tilting or rolling around or falling down as seen in prior art.

CONCLUSION, RAMIFICATIONS, AND SCOPE

Accordingly, the reader will see the present invention can be easily converted from a crutch to a cane or vice versa. The reader will also see the invention places the patient's hand, wrist, and upper arm in an ergonomically comfortable position, thereby eliminating unnecessary stress concentration on user's hand, wrist and upper arm, allowing the patient to concentrate on overall weight distribution placed on patient's fractured or disabled lower limbs. As shown in FIG. 4, (the cane), said forearm sleeve remains as is covering support shaft 10 above handle 18. Again, the forearm sleeve is simply a length of round foam tubing. Although simple, it is very effective. The patient's forearm, being straight and rigid, rests firmly against said forearm sleeve; thereby, stabilizing the cane as well as the patient's arm.

The net result being a stable, safe, comfortable crutch/cane, that eliminates the "wobbly-cane" syndrome experienced by the elderly. The forearm support sleeve then being a "stabilizer"; simple, but very effective.

In addition, it is also important to note that handle-grip 28 can be quickly and easily removed for washing and cleansing, thereby preventing human to human transfer of deadly bacteria such as *E. Coli*, Salmonella, Listeria, Cryptosporidium, etc. As yet, no where can it be found in known prior art, any reference to the fact that crutch handle-grips are prime carriers of harmful bacteria and, therefore, should be frequently removed and cleansed without having to disassemble the crutch or cane to gain access to said handle-grip. Other advantages are as follows:

The main support shaft is without a plurality of adjustment holes, thereby eliminating points of structural stress concentration as seen in prior art.

Under the circumstances, the strength to weight ratio of a square tubular shaft is always greater than that of a round tubular shaft as shown in prior art. Therefore, a square tubular support shaft can be made lighter and stronger resulting in efficient use of materials; less weight, less cost.

As a crutch, it is quick to respond because of its ultra light weight.

As a crutch or cane it is inherently much safer than prior art because of its, high maneuverability and quick response time.

In operation, the user has a better feel for even weight distribution on his/her fractured or disabled lower limb because of the unique handle, handle position, forearm support and ultra light weight.

Height adjustment is made from the top of the crutch rather than the bottom making it easier to adjust.

The handle that is clamped to the support shaft is infinitely adjustable up or down, eliminating incremental adjustment as seen in prior art.

Furthermore, as a crutch or cane, it can be conveniently set aside in an upright position on a horizontal surface such as a table top, counter top, window sill, etc. Although the foregoing description contains many specifics, these should not be construed as limiting the scope of the invention, but merely providing illustrations of some of the preferred embodiments of this invention. For example, handle 18, support shaft 10, and cradle 12 can to made of high strength composite plastics materials of which there are many to choose from. Also, there are many types of readily available commercial pin arrangements that can replace cradle pin 14 and thumb nut 16, such as the quick release pins, manufactured by Aerofast, Inc., Carol Stream, Ill. known as "Faspins", which requires no screw or nut to secure it in place.

The dimensional sizes given herein are preferred sizes only and can be changed according to the strength of the materials used. Thus, the scope of this invention should be determined by the appended claims and their legal equivalents, rather than by the examples given.

I claim:

1. An adjustable, universal walking crutch/or cane, comprising:

(a) a single main support shaft made of straight, rigid, square tubular material;

(b) said support shaft having an upper end and a lower end;

(c) said support shaft having a square tubular cross section of sufficient in size and strength to safely support the body weight of a heavy human being;

(d) an adjustable underarm cradle incorporating a concave shaped cradle bed with a square shaped cradle stem extending downward from said cradle bed telescoping inside said upper end of said square tubular support shaft;

(e) a cradle cap made of soft cushion-like material and slip fitting over said cradle bed providing an underarm cushion;

(f) a crutch handle with a body encasing said square support shaft;

(g) said crutch handle having clamping means for attachment to said support shaft, said clamping means including a substantial rectangular flange protruding perpendicular from said handle body;

(h) said crutch handle having a round tubular handlebar centered laterally on said support flange and perpendicular to said support flange and said support shaft;

(I) said handlebar being mounted on a true horizontal plane parallel to a face of said cradle bed;

(j) said handlebar being adapted to be centrically located directly below shoulder mass of user extending outward from said support shaft;

(k) said handlebar being located in line with a center line of said underarm cradle;

(l) a handle grip made of soft cushion-like material and slip fitting over said handlebar providing user with a removable hand cushion;

(m) a crutch handle being adjustable up or down to accommodate position of user's hand in operation of said crutch or cane;

(n) a predetermined length of round plastic foam tubing slip fitting over said support shaft above said crutch handle for providing means of forearm support for a user;

(o) a resilient rubber tip fitting over said lower end of said support shaft.

2. The support shaft of claim 1 wherein said shaft has a predetermined cross section approximately 18.9 mm, ¾ inch, square outside dimension and 15.7 mm, ⅝ inch, square inside dimension.

3. The support shaft of claim 1 further including a single hole through said support shaft near its upper end to facilitate means for overall crutch height adjustment.

4. The underarm cradle of claim 1 further including a 15.7 mm, ⅝ inch, square stem sized to freely telescope inside said support shaft.

5. The underarm cradle of claim 1 further including a series of holes through said cradle stem to facilitate means for overall crutch height adjustment.

6. The walking crutch of claim 1 further including telescoping means for securing said cradle stem within said support shaft thereby securing said cradle inside said support shaft; thereby, fixing crutch height to suit individual user.

7. The crutch handle of claim 1 further including a handle body that has a female keyway slot that slip fits over and encases said support shaft, thereby keying said handle in place.

8. The crutch handle of claim 1 wherein said a rectangular cross section support flange protruding from said handle body intersecting with said handlebar.

9. The crutch handle of claim 1 further including a substantial support radius under said rectangular support flange.

10. The crutch handle of claim 1 wherein said handle bar is unsupported, unrestricted, and unobstructed at both ends leaving both ends open, free, and unencumbered.

11. The handle grip of claim 1 further including keying means for quick and easy removal of said handle grip to facilitate washing and cleansing.

12. The crutch of claim 1 wherein said crutch has less than twelve individual, parts throughout entire assembly.

13. The crutch of claim 1 wherein said crutch being converted from a walking crutch to a walking cane by removing said cradle pin and underarm cradle.

14. The crutch or cane of claim 1 whereby users wrist, forearm, and upper arm are arranged in order to be substantially straight and rigid in operation of said crutch or cane; wherein, user's forearm is not required to bend at elbow.

15. The crutch or cane of claim 1 whereby user's hand is turned outwardly when operating said crutch or cane; thereby, placing user's body weight across the heel portion of the palm of the user's hand.

16. The crutch or cane of claim 1 wherein said handle of the crutch or cane can be set to rest in an upright position on a solid horizontal surface when not in use; setting firmly and solidly in place without tipping or pivoting.

* * * * *